US005667336A

United States Patent [19]

Zur

[11] Patent Number: 5,667,336

[45] Date of Patent: Sep. 16, 1997

[54] FURROW IRRIGATION

[75] Inventor: Benjamin Zur, Kiryat Tivon, Israel

[73] Assignee: Technion Research and Development Foundation, Haifa, Israel

[21] Appl. No.: 492,340

[22] Filed: Jun. 19, 1995

[30] Foreign Application Priority Data

Jun. 20, 1994 [IL] Israel ..... 110054

[51] Int. Cl.[6] ..... F02B 13/00

[52] U.S. Cl. ..... 405/37; 405/36; 405/39; 137/78.3; 239/63

[58] Field of Search ..... 405/36, 37, 39, 405/40; 239/63, 64; 137/78.3, 487.5

[56] References Cited

U.S. PATENT DOCUMENTS

| | | | |
|---|---|---|---|
| 2,785,006 | 3/1957 | Young et al. | 137/78.3 |
| 3,114,243 | 12/1963 | Winters | 405/37 |
| 3,628,563 | 12/1971 | Takehiko | 137/487.5 X |
| 3,952,522 | 4/1976 | Shettel | 405/37 |
| 4,431,338 | 2/1984 | Hornobrook | 405/37 |
| 4,464,079 | 8/1984 | Chance | 405/37 |
| 5,341,831 | 8/1994 | Zur | 239/63 X |

FOREIGN PATENT DOCUMENTS

| | | | |
|---|---|---|---|
| 1690616 | 11/1991 | U.S.S.R. | 405/37 |

*Primary Examiner*—Tamara L. Graysay
*Assistant Examiner*—Frederick L. Laeman
*Attorney, Agent, or Firm*—Fitch, Even, Tabin & Flannery

[57] ABSTRACT

An automated furrow irrigation control method and system involves the initiation of an irrigation flow into an upstream end of a furrow at an initial water discharge rate; continuously or periodically sensing the progress of water flow along the furrow; continuously or periodically increasing the water discharge rate in response to the sensed progress of the water flow so as to ensure a substantially continuous flow in the furrow at a flow rate which lies substantially between ±30% of a constant value; sensing the arrival of the water flow at a downstream end of the furrow; reducing the water discharge rate in response to the sensed arrival of the water flow at the downstream end of the furrow; sensing the percolation of the water flow at the downstream end down to a predetermined depth; and terminating the irrigation flow in response to the sensed percolation.

7 Claims, 8 Drawing Sheets

FURROW IRRIGATION

FIELD OF THE INVENTION

This invention relates to furrow irrigation and in particular to a furrow irrigation control method.

BACKGROUND OF THE INVENTION

Furrow or flood irrigation is probably one of the oldest known forms of irrigation and involves discharging irrigation water into and along an elongated furrow which generally slopes downwardly from an upstream end to a downstream end, the irrigation continuing until it is ensured that the irrigation water has percolated down to the root level of the plants to be irrigated. Such furrow irrigation has long been known to be inefficient seeing that the degree of percolation of the irrigation water in the initial upstream portion of the furrow is greater than in the downstream portions thereof. In order to ensure that, in these downstream portions the irrigation water percolates to the required soil depth, the flow of irrigation water along the furrow must be continued and, as a consequence, there is excessive percolation in the upstream portions. In addition, since the infiltration rate along the furrow reaches a stable value maintaining a constant flow in the furrow results in a water overflow at the end of the furrow constituting so-called "tail water loss". This is not only wasteful in terms of water consumption but the excessive percolation carries with it the additional disadvantage that, in the upstream portions the water percolating downwardly beyond the root level carry with it soluble salts thereby depleting the upper soil layers of these salts and giving rise to the pollution of the water table and a rise in its level.

It is well known that a major reason for the differential percolation of the water along the length of the furrow arises out of the fact that as the water flows down the furrow there is a steady decrease in the volume of the flow particularly in the downstream portions of the furrow. The stage during which the irrigation water flows from its upstream to its downstream end is known as the "advance stage" of furrow irrigation. Once the advance stage has been completed, i.e. the water flow will have reached the downstream end, the so-called "soaking stage" begins and continues until it is ensured that, at the downstream end the water will have percolated to the root level. By this time however, as indicated above, the water at the upstream portion will have percolated well below the root level in that region and considerable tail water loss will have occurred.

Irrigation efficiency $E_{ff}$ is defined as being the ratio of the amount of irrigation water ($W_r$) percolating down to the root level along the length of the furrow to the total amount of water applied during the irrigation ($W_t$), i.e. $E_{ff}=W_r/W_t$.

Clearly the closer $W_r$ approaches $W_t$ the higher the efficiency of the irrigation.

In practice, it is found that irrigation efficiency $E_{ff}$ for furrow irrigation does not exceed 50%.

Various attempts have been made to improve the efficiency of furrow irrigation and these attempts have all been directed to decreasing the duration of the advance stage seeing that the lower this duration the lesser the degree of percolation in the upstream portions of the furrow.

Among known attempts to reduce the duration of the advanced stage can be mentioned the following:

1. a reduction in the infiltration capacity of the soil by compaction or other means;
2. increasing the slope of the furrow; and 3. increasing the water discharge rate into the furrow.

Various combinations of these means have also been proposed. However, none of these hitherto proposed means have been particularly successful in increasing efficiency, thus, for example, undue increase of the furrow slope or of the water discharge rate significantly increases the danger of soil erosion. On the other hand, the use of shorter furrows so as to decrease the duration of the advance stage proves to be uneconomical.

A further proposal which has been made in an attempt to increase the efficiency of furrow irrigation has involved so called "surge irrigation ", wherein water is introduced into the upstream end in surge-like pulses of a relatively lengthy duration. During the "on" period, water flows down a section of the furrow whilst during the following "off" period, the surface of the irrigated section dries off as a result of the percolation of the water and, it is believed that the percolation capacity of that section decreases relatively speedily. During the subsequent "on" period, the irrigation water would be expected to flow along the preceding section at a relatively increased rate (owing to its supposed reduced percolation rate) and in this way it is believed that the overall duration of the advance stage is reduced. It is to be noted in this connection that with such surge irrigation there is no continuous flow of irrigation water along the furrow during the entire duration of the advance stage. In practice, however, it has not been found that surge irrigation results in any significant increase in irrigation efficiency and any theoretical explanation for the promise of success vis-a-vis actual relative lack of success is not well established. Furthermore, surge irrigation has not been found to correct, in a satisfactory manner, tail water loss.

It is an object of the present invention to provide a new and improved automated furrow irrigation control method which results in a significantly reduced advanced stage duration as well as the reduction or prevention of tail water loss and consequently, a significantly increased irrigation efficiency.

BRIEF SUMMARY OF THE INVENTION

According to the present invention there is provided an automated furrow irrigation control method comprising the steps of (a) initiating an irrigation flow into an upstream end of a furrow at an initial water discharge rate;

(b) continuously or periodically sensing the progress of water flow along said furrow;

(c) continuously or periodically increasing the water discharge rate in response to the sensed progress of said water flow so as to ensure a substantially continuous flow in said furrow at a flow rate which lies substantially between ±30% of a constant value;

(d) sensing the arrival of said water flow at a downstream end of said furrow;

(e) reducing said water discharge rate to a reduced value in response to the sensed arrival of said water flow at a downstream end of said furrow;

(f) sensing the percolation of said water flow at said downstream end down to a predetermined depth; and (g) terminating said irrigation flow in response to said sensed percolation.

Preferably there is also sensed the height of the water level at said downstream end and the water discharge rate is adjusted so as to ensure that the height does not exceed a predetermined maximum. In this way tail water loss can be significantly reduced or avoided.

As an alternative to the continuous or periodical increasing of the water discharge rate the irrigation flow can be introduced as an intermittent flow into the upstream end of the furrow at a substantially constant discharge rate which is effectively equal to the maximum discharge rate required for the water to reach the downstream end with a reduced duration of the advance stage. In order, however, to ensure that this increased discharge rate does not lead to undesired erosion, the periodicity of the intermittent discharge into the furrow is periodically adjusted in response to the sensed progress of the water flow so as to ensure that the overall water flow rate in the furrow lies substantially between ±30% of a constant value.

As a result of achieving the substantially constant water flow rate in the furrow (as compared with the drastic reduction in the water flow rate with conventional furrow irrigation), a very significant reduction in the duration of the advance stage can be achieved as well as a substantial elimination of tail water loss, and this leads in its turn to a very significant increase in the efficiency of the irrigation.

By virtue of the substantial elimination of tail water loss it becomes possible and advantageous to arrange for the furrow irrigation to be carried out with fertilizer injection.

The sensing of the progress of the water along the furrow is effected by locating along its length successive sensors which are responsive to the arrival of the water flow and which are coupled with a control sensor which in its turn serves to operate a variable discharge valve for the purpose of increasing the discharge rate in response to the sensed progress of the water flow.

DETAILED DESCRIPTION OF EMBODIMENTS OF THE PRESENT INVENTION

Figure 1:
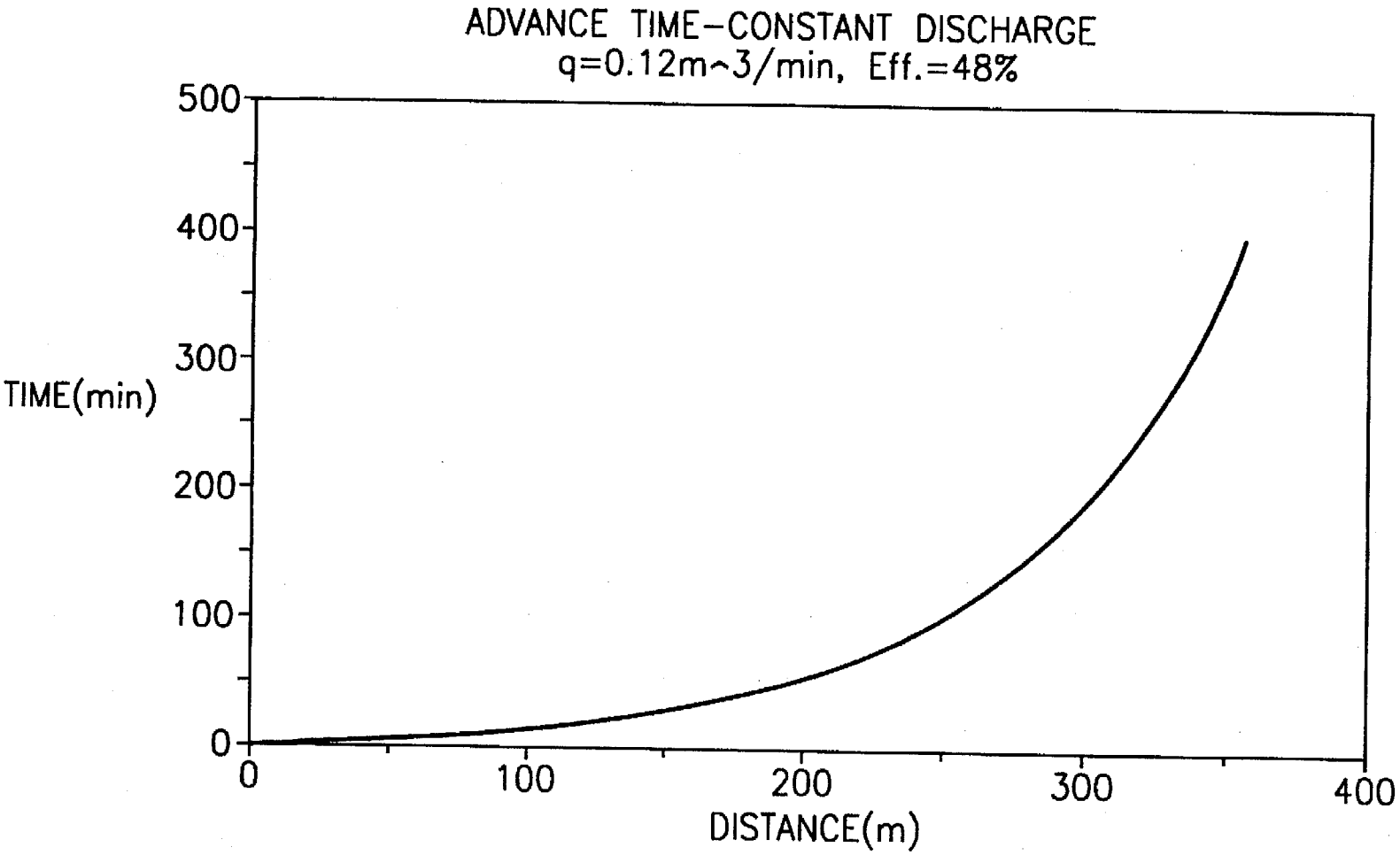
FIG. 1 is a curve illustrating the advance of water front with time with conventional furrow irrigation.

As seen in FIG. 1, with conventional furrow irrigation and a constant discharge rate of 0.12 cubic meters per minute the time taken for the water front to progress along the length of the furrow increases asymptotically clearly indicating the significant duration of the advance stage. The irrigation efficiency does not exceed 48%.

If now, in accordance with the invention the progress of water flow in continuously or periodically sensed along the furrow and the discharge rate into the furrow is continuously or periodically increased so as to ensure a substantially continuous flow in the furrow at a velocity which is substantially constant (in practice does not vary from a constant value by about 30%) the advance time is substantially reduced.

Once the advance stage will have been completed, and this is determined by sensing the arrival of water flow at a downstream end of the furrow, the flow rate is reduced to a value corresponding to a stable infiltration rate in the furrow and the soaking stage ensues and continues until the percolation of the water at the downstream end to a predetermined level (root level) has been sensed, at which stage the irrigation flow is terminated.

Figure 2:
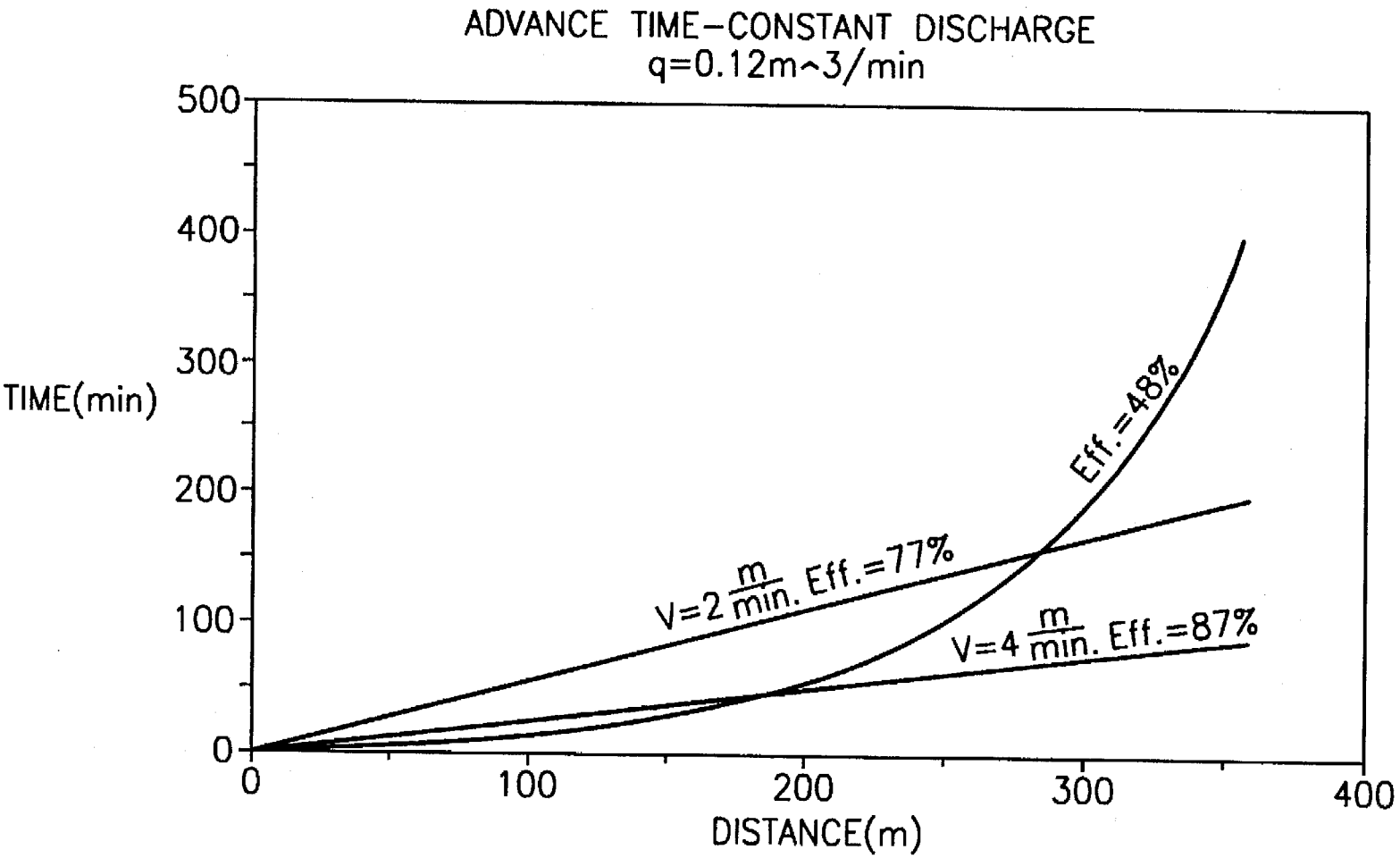
FIG. 2 shows, superimposed on the curve shown in FIG. 1, the advance of the water front with time with substantially constant flow rate in accordance with the present invention.

If now we consider FIG. 2 where there is superimposed on the previously discussed curve the rate of advance of the water front under substantially constant flow rate conditions (as are achieved in accordance with the present invention), it can be seen that with a flow rate velocity of 2 meters per minute an efficiency of 77% is achieved whilst with a flow rate velocity of 4 meters per minute an efficiency of 87% is achieved, all this being due to the considerable reduction in the duration of the advanced stage.

Figure 3:
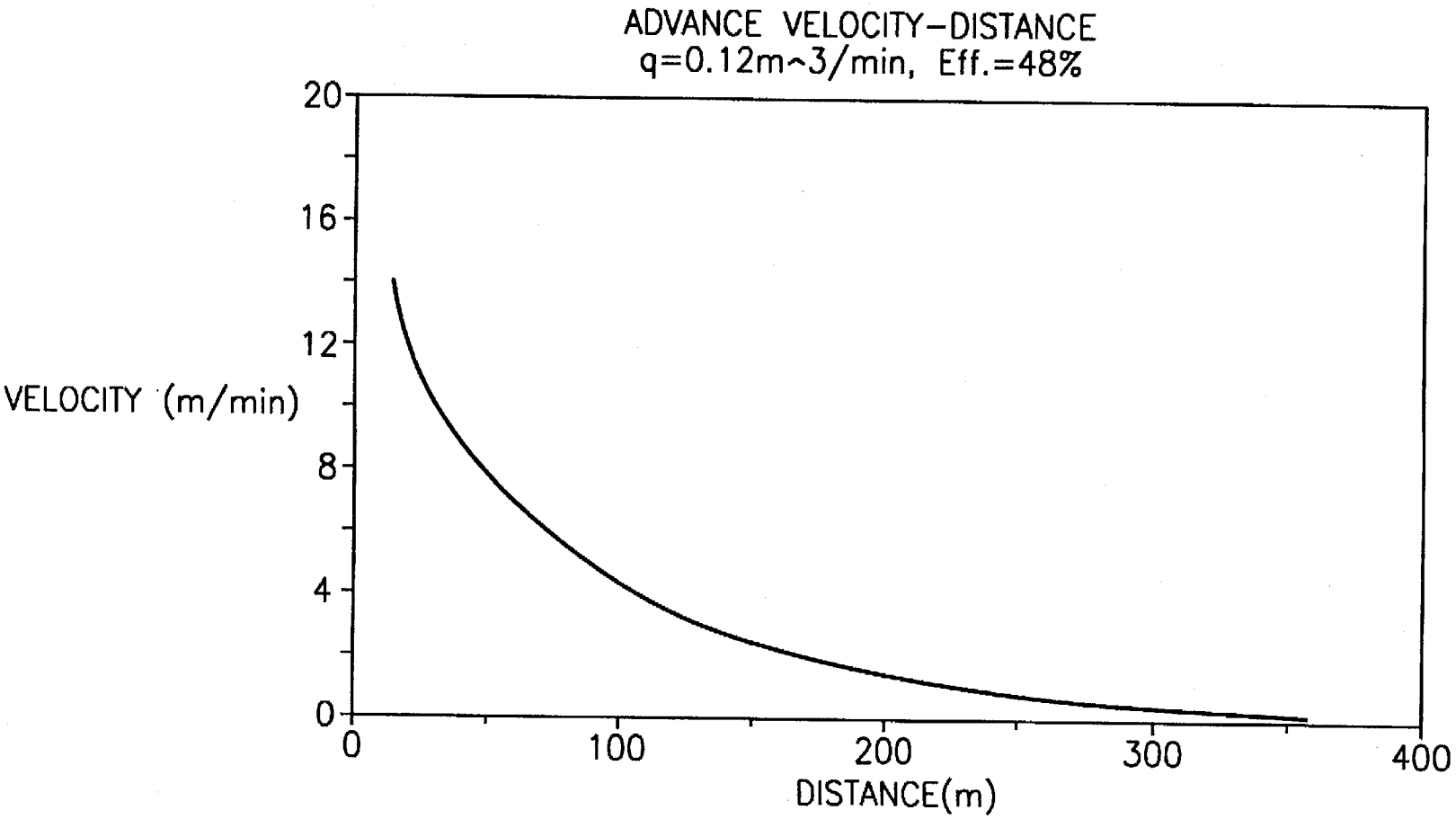
FIG. 3 is a curve showing the variation in water flow rate with furrow distance with conventional furrow irrigation on the one hand and with substantially constant flow rate in accordance with the invention on the other hand.

This phenomenon is clearly illustrated in FIG. 3 of the drawings where there is shown for the same initial discharge rate the reduction in flow rate velocity for conventional furrow irrigation along the length of the furrow. Superimposed on this curve there is shown the substantially constant velocity of respectively 4 and 2 cubic meters per minute achieved in accordance with the present invention.

Figure 4:
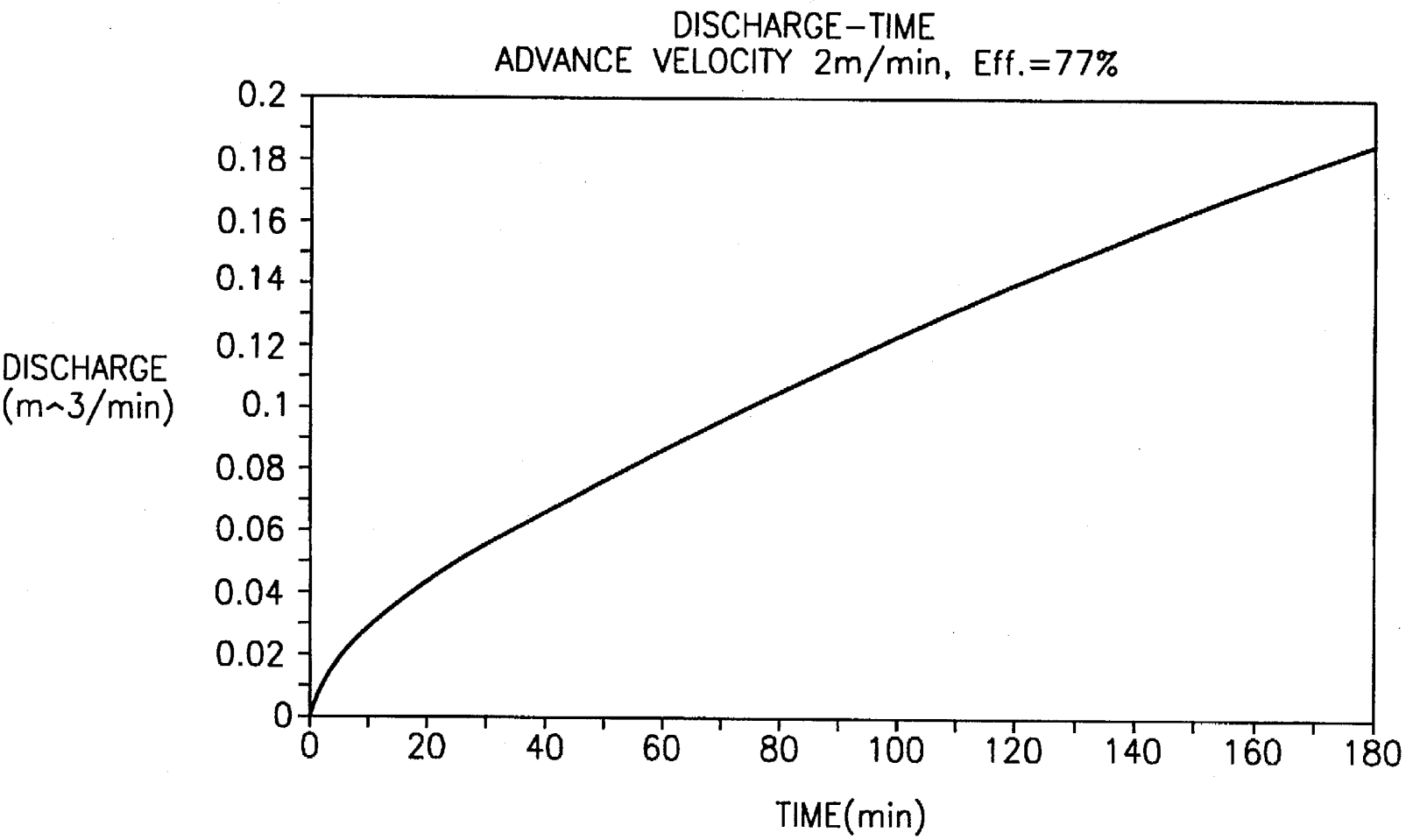
FIG. 4 illustrates the successive increase in discharge rate with time with furrow irrigation in accordance with the present invention.

FIG. 4 shows how with a substantially constant flow rate velocity of 2 meters per minute, the discharge rate increases substantially linearly with time in accordance with the present invention.

Figure 5:
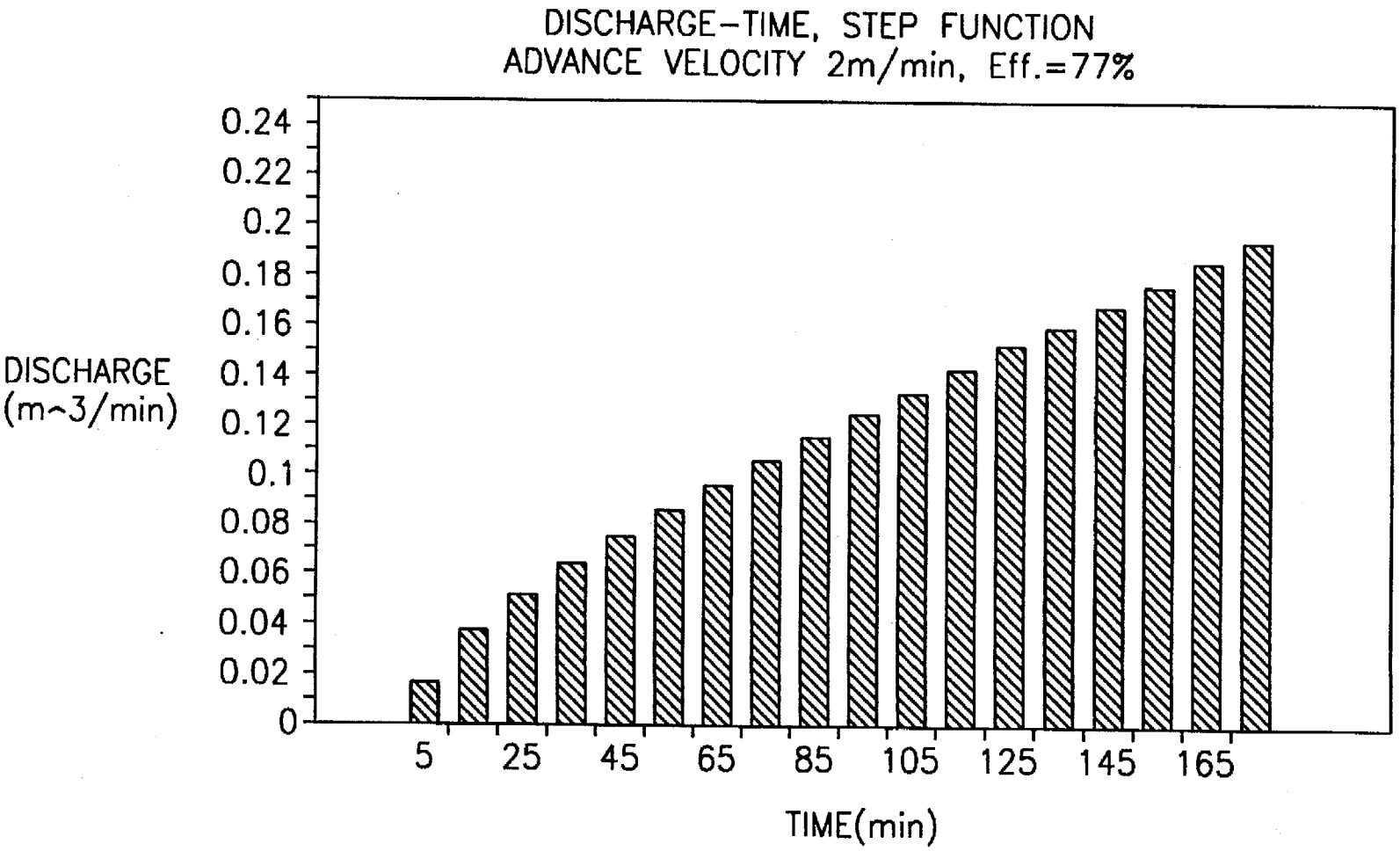
FIG. 5 illustrates an intermittent increase in discharge rate with time with furrow irrigation in accordance with the present invention.

FIG. 5 illustrates a stepwise or intermittent increase in discharge rate in response to the sensed progress of the water front along the length of the furrow. Thus, as can be seen, at intervals of 10 minutes, the discharge rate is successively increased, in this case as a result of the sensing of the advance of the water front by sensors which are located at 20 meter intervals along the length of the furrow.

Figure 6:
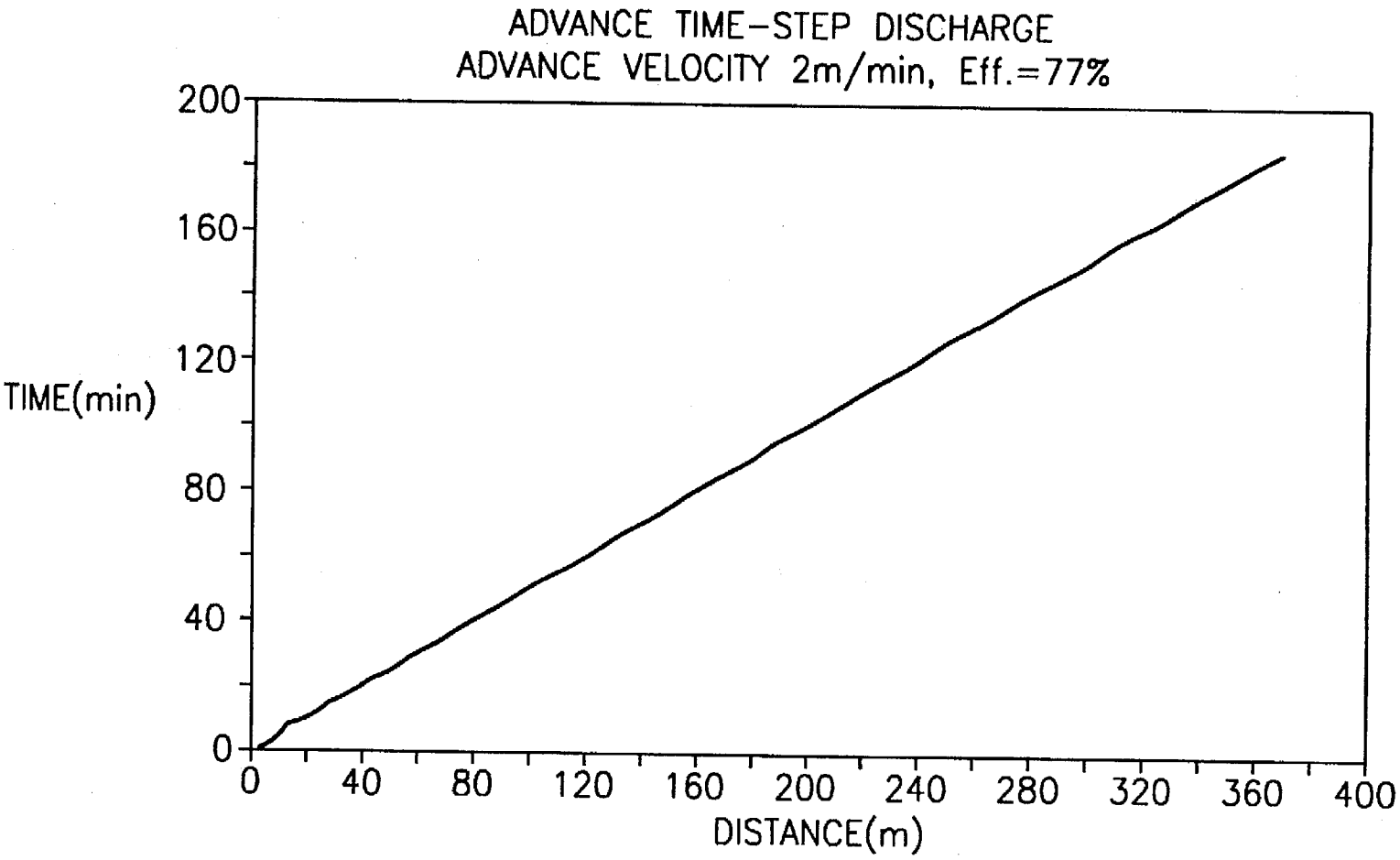
FIG. 6 illustrates the advance of the water front along the furrow as a function of time with furrow irrigation in accordance with the present invention.

FIG. 6 shows the substantially linear variation of the advance of the water front with time for a constant discharge rate velocity of 2 meters per minute resulting in an irrigation efficiency of 77%.

As indicated above, with the completion of the advance stage with final sensors disposed adjacent the downstream end of the furrow sensing the arrival of the water front and the height thereof, the discharge rate is reduced and the soaking stage is initiated and this continues until a wetting depth sensor located adjacent the downstream end of the furrow senses the percolation of the water to root level at which stage the irrigation flow is terminated.

Figure 7:
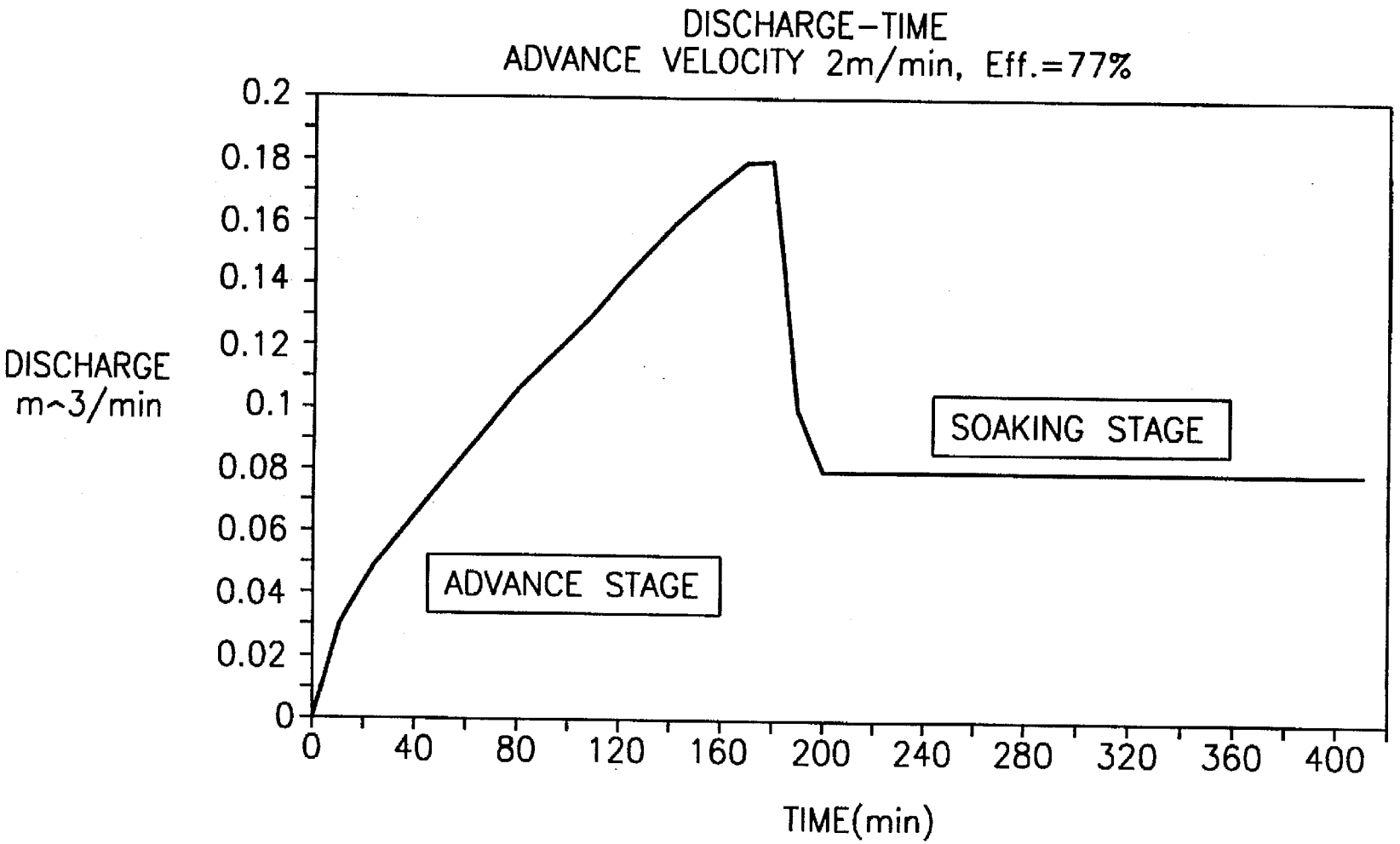
FIG. 7 illustrates the variation of discharge rate with time over the combined advance and soaking stages for a specific example of the method in accordance with the invention.

FIG. 7 illustrates schematically the combined advance and soaking stages, i.e. the variation of discharge rate with time. In this particular example, with a furrow 360 meters in length, with sensors spaced at 20 meter intervals, an advance stage duration is 180 mins. whilst the subsequent soaking stage lasts about 220 min. During the advance stage the discharge rate is increased to 0.18 $m^3$/mins. and during the soaking stage it is decreased to 0.08 $m^3$/min.

Figure 8:
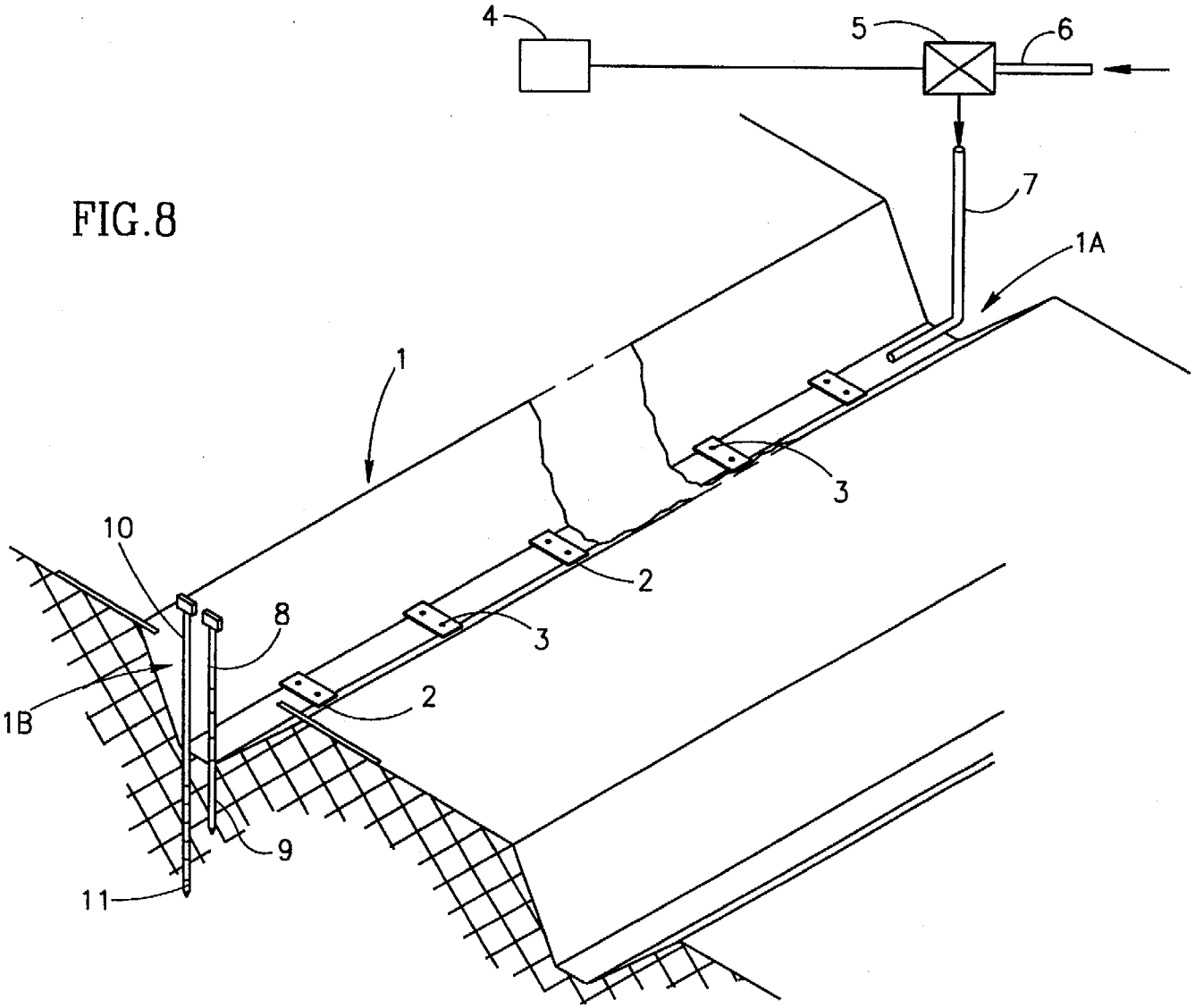
FIG. 8 is a schematic representation of a furrow and associated sensors and water flow control installation.

Reference will now be made to FIG. 8 of the drawings which shows schematically the distribution of sensors along the length of a furrow and an associated water flow control installation.

As seen in the drawing a furrow 1 extends from an upstream end 1*a* to a downstream end 1*b*. Located on the bed of the furrow 1 and distributed along the length thereof are water front detection sensors 2. Each sensor 2 is provided with a pair of horizontally spaced apart electrodes 3 such that when contacted by the water front, an electric circuit (not shown), incorporated in the sensor 2, is closed. The sensors 2 are coupled by wire or by wireless coupling (e.g. infrared, radio, laser coupling etc.) to a control centre 4 which is in turn responsively coupled to a variable water flow valve 5 having an input 6 coupled to a water supply source (not shown) and an output 7 coupled to a water discharge conduit which opens into the upstream end 1*a* of the furrow 1.

Located at the downstream end 1*b* of the furrow is a water front arrival and height detection sensor 8 which projects above the bed of the furrow 1 and is provided with a succession of electrodes 9 spaced along the length of the sensor. As the waterfront level reaches successive electrodes, successive electric circuits (not shown) are closed. The sensor 8 is coupled to the control centre 4.

Also located at the downstream end 1*b* of the furrow 1 and inserted into the bed of the furrow is a wetting depth sensor 10 (e.g. of the kind described in U.S. Pat. No. 5,341,831). The buried end of this sensor 10 is provided with a succession of axially spaced apart electrodes 11, coupled to corresponding electrical circuits (not shown) so as successively to close these circuits in response to the wetting depth of the soil at the downstream end 1*b*. The sensor 10 is coupled to the control centre 4.

Thus, the progress of the water front along the furrow 1 is sensed by the sensors 2, which are responsive to the arrival of the water front and appropriate signals are transmitted to the control center 4. The control center 4 serves to simulate the flow along the furrow 1 on the basis of flow volume balance. Thus, the control center 4 is capable of computing times of arrival of the water front at the individual sensors 2 as well as the height of the water at any particular region of the furrow 1 and converting the computed data to control the operation of the variable valve 5 so as to obtain the desired discharge rate. Furthermore, the control center 4 is capable of establishing the conditions for stable infiltration rate during the advanced stage so that when the end of the advanced stage is sensed by the water front arrival sensor 8, suitable instructions are communicated to the variable valve so as to reduce the discharge rate to a value adequate for ensuring the efficient carrying out of the soaking stage. At the same time the height of the water level at the downstream end 1*b* is monitored by the sensor 8 so that any tendency for this level to exceed a predetermined maximum results in a corresponding adjustment of the water discharge rate. The termination of the soaking stage is determined when the wetting depth sensor 10 senses the arrival of the percolated water at root level at the downstream end 1*b* of the furrow 1.

In order to determine the water discharge rate required to achieve a desired flow velocity in the furrow, a simulating procedure is employed by which a simulation is fed with all the characteristic data of the furrow, e.g. soil nature and density, furrow inclination etc., and is used to determine the required discharge rate for any desired flow velocity.

It will be understood that differing forms of water front detection sensors may be employed. Thus, instead of the sensors 2 located on the bed of the furrow 1, the arrival of the water front can be sensed by laser detectors located on the bank of the furrow and directing a laser beam to the bed. Other suitable optical or electrical sensors can be readily envisaged.

The provision of the water front height detection center 8 ensures that the soaking stage is effected without any significant tail water loss. In consequence it becomes practical to inject into the water discharge, fertilizer, the amount and rate of discharge being also controlled by the control centre 4.

Whilst, as described above, the control center 4 is effective in operating the variable valve 5 during the advanced stage so as gradually to increase the discharge rate in an alternative embodiment where there is initiated an intermittent irrigation flow into the upstream end of the furrow at a maximum constant discharge rate, the control center is effective in periodically adjusting the periodicity of the intermittent discharge into the furrow so as to ensure that the overall flow in the furrow lies substantially within ±30° of a constant value.

I claim:

1. An automated furrow irrigation control method comprising the steps of (a) initiating an irrigation flow into an upstream end of a furrow at an initial water discharge rate;

(b) continuously or periodically sensing progress of water flow along said furrow;

(c) continuously or periodically increasing the water discharge rate in response to sensed progress of said water flow so as to ensure a substantially continuous flow in said furrow at a flow rate which lies substantially between ±30% of a constant value;

(d) sensing arrival of said water flow at a downstream end of said furrow;

(e) reducing said water discharge rate in response to the sensed arrival of said water flow at the downstream end of said furrow;

(f) sensing percolation of said water flow at said downstream end down to a predetermined depth; and (g) terminating said irrigation flow in response to said sensed percolation.

2. An automated furrow irrigation control method according to claim 1 and furthermore including the steps of sensing water level height at said downstream end and adjusting the discharge rate so as to ensure that this height does not exceed a predetermined maximum.

3. An automated furrow irrigation control method comprising the steps of (a) initiating an intermittent irrigation flow into an upstream end of a furrow at a substantially constant water discharge rate;

(b) periodically sensing progress of water flow along said furrow;

(c) periodically adjusting intermittent discharge periodicity into said furrow in response to the sensed progress of said water flow so as to ensure a substantially continuous flow in said furrow at an overflow rate which lies substantially between ±30% of a constant value;

(d) sensing arrival of said water flow at a downstream end of said furrow;

(e) reducing said water discharge rate in response to the sensed arrival of said water flow at the downstream end of said furrow;

(f) sensing percolation of said water flow at said downstream end down to a predetermined depth; and (g) terminating said irrigation flow in response to said sensed percolation.

4. An automated furrow irrigation control method according to claim 3 and furthermore including the steps of sensing water level height at said downstream end and adjusting the discharge rate so as to ensure that this height does not exceed a predetermined maximum.

5. An automated furrow irrigation control installation comprising (a) a flow control valve for controlling discharge of irrigation water into an upstream end of a furrow;

(b) a control center for controlling operation of said control valve;

(c) a plurality of water flow sensors adapted to be spaced along said furrow for sensing water flow along said furrow and coupled to said control mechanism; and (d) a flow depth sensor adapted to be located at a downstream end of said furrow and coupled to said control center;

said control mechanism responding to output of said sensors so as to adjust water discharge rate from said valve so as to ensure a substantially constant flow rate in said furrow in an advanced stage and so as to terminate irrigation at an end of a soaking stage.

6. An automated furrow irrigation control system comprising:

a valve for initiating an irrigation flow into an upstream end of a furrow at an initial water discharge rate;

first sensor apparatus for continuously or periodically sensing progress of water flow along said furrow;

control apparatus for continuously or periodically increasing the water discharge rate in response to the sensed progress of said water flow so as to ensure a substantially continuous flow in said furrow at a flow rate which lies substantially between ±30% of a constant value;

second sensing apparatus for sensing arrival of said water flow at a downstream end of said furrow, the control apparatus being responsive to the second sensing apparatus by reducing said water discharge rate in response to the sensed arrival of said water flow at the downstream end of said furrow;

third sensing apparatus for sensing percolation of said water flow at said downstream end down to a predetermined depth; and apparatus for terminating said irrigation flow in response to said sensed percolation.

7. An automated furrow irrigation control system comprising:

a valve for initiating an intermittent irrigation flow into an upstream end of a furrow at a substantially constant water discharge rate;

first sensing apparatus for periodically sensing progress of water flow along said furrow;

control apparatus for periodically adjusting periodicity of intermittent flow into said furrow in response to the sensed progress of said water flow so as to ensure a substantially continuous flow in said furrow at a flow rate which lies substantially between ±30% of a constant value;

second sensing apparatus for sensing arrival of said water flow at a downstream end of said furrow, the control apparatus reducing said water discharge rate in response to sensed arrival of said water flow at the downstream end of said furrow; and third sensing apparatus for sensing percolation of said water flow at said downstream end down to a predetermined depth, and terminating said irrigation flow in response to said sensed percolation.

* * * * *